US012715082B2

(12) United States Patent
Mori et al.

(10) Patent No.: US 12,715,082 B2
(45) Date of Patent: Aug. 25, 2026

(54) WET BLASTING TREATMENT DEVICE AND WET BLASTING TREATMENT METHOD

(71) Applicant: MITSUBISHI HEAVY INDUSTRIES, LTD., Tokyo (JP)

(72) Inventors: Hiroki Mori, Tokyo (JP); Takumi Sato, Tokyo (JP); Takayuki Takahashi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 756 days.

(21) Appl. No.: 18/094,593

(22) Filed: Jan. 9, 2023

(65) Prior Publication Data

US 2023/0256565 A1 Aug. 17, 2023

(30) Foreign Application Priority Data

Feb. 15, 2022 (JP) ..... 2022-021066

(51) Int. Cl.

| | |
|---|---|
| ***B24C 7/00*** | (2006.01) |
| ***B24C 1/04*** | (2006.01) |
| ***B24C 5/04*** | (2006.01) |
| ***B24C 9/00*** | (2006.01) |

(52) U.S. Cl.

CPC ..... *B24C 7/0015* (2013.01); *B24C 1/04* (2013.01); *B24C 5/04* (2013.01); *B24C 9/006* (2013.01)

(58) Field of Classification Search

CPC ..... B24B 49/12; B24B 55/02; B24B 55/03; B24B 55/12; B24B 57/02; B24B 57/00; B24C 3/06; B24C 3/065; B24C 3/2228; B24C 1/08; B24C 1/04; B24C 1/086;

(Continued)

(56) References Cited

U.S. PATENT DOCUMENTS 3,192,677 A * 7/1965 Willard ..... B44D 3/16 451/87
4,753,051 A * 6/1988 Tano ..... B24C 1/00 451/3

(Continued)

FOREIGN PATENT DOCUMENTS

JP 2013-146850 A 8/2013
JP 2013-158884 A 8/2013

(Continued)

OTHER PUBLICATIONS

Japanese Office Action for Japanese Application No. 2022-021066, dated Jun. 3, 2025, with English translation.

*Primary Examiner* — Robert F Neibaur
(74) *Attorney, Agent, or Firm* — Birch, Stewart, Kolasch & Birch, LLP

(57) ABSTRACT

Provided is a wet blasting treatment device including a first nozzle unit that discharges, toward a target treatment region of a workpiece, slurry in which a first liquid and abrasive grains are mixed, a second nozzle unit that discharges a second liquid toward an untreated region adjacent to the target treatment region such that a liquid film is formed in the target treatment region of the workpiece, and a control unit that controls a discharge amount of the second liquid discharged by the second nozzle unit such that the liquid film has a predetermined thickness.

14 Claims, 5 Drawing Sheets

(58) Field of Classification Search
CPC ..... B24C 7/0007; B24C 7/0015; B24C 7/00; B24C 11/00; B24C 5/02
USPC ..... 451/5, 38, 60, 75, 87, 88, 89, 99, 446, 451/447
See application file for complete search history.

(56) References Cited

U.S. PATENT DOCUMENTS

| | | | | |
|---|---|---|---|---|
| 5,827,114 | A * | 10/1998 | Yam | B24C 7/0038 451/60 |
| 2018/0202049 | A1 | 7/2018 | Duc | |
| 2021/0146621 | A1 * | 5/2021 | Olausson | B24C 1/08 |
| 2021/0154799 | A1 * | 5/2021 | Dean, Jr. | B24C 9/00 |

FOREIGN PATENT DOCUMENTS

| | | | |
|---|---|---|---|
| JP | 5749324 | B2 | 7/2015 |
| JP | 6249929 | B2 | 12/2017 |
| JP | 2021-154360 | A | 10/2021 |
| WO | WO 2011/083605 | A1 | 7/2011 |

* cited by examiner

WET BLASTING TREATMENT DEVICE AND WET BLASTING TREATMENT METHOD

CROSS-REFERENCE TO RELATED APPLICATIONS

This application claims the benefit of priority to Japanese Patent Application Number 2022-021066 filed on Feb. 15, 2022. The entire contents of the above-identified application are hereby incorporated by reference.

TECHNICAL FIELD

The disclosure relates to a wet blasting treatment device and a wet blasting treatment method.

RELATED ART

There has been known a wet blasting treatment device that performs surface treatment of an object to be treated by spraying slurry that is a mixture of a liquid and abrasive grains (see, for example, JP 5749324 B). The wet blasting treatment device of JP 5749324 B supplies air from a blower with a constant air pressure to a slurry spraying unit that sprays slurry.

SUMMARY

However, since the pressure of the air supplied to the slurry spraying unit is constant, the wet blasting treatment device of JP 5749324 B cannot adjust the machining amount (machining depth) of the object to be treated per unit time. When an air supply source such as a compressor is used so that the pressure of the air supplied to the slurry spraying unit can be adjusted, the introduction cost and the running cost of the wet blasting treatment device increase.

The disclosure has been made in view of such circumstances, and an object is to provide a wet blasting treatment device and a wet blasting treatment method that are capable of adjusting a machining amount of an object to be treated per unit time without increasing an introduction cost and a running cost.

In order to solve the problem described above, the disclosure adopts the following means.

A wet blasting treatment device according to one aspect of the disclosure includes a first nozzle unit that discharges, toward a target treatment region, slurry in which a first liquid and abrasive grains are mixed, a second nozzle unit that discharges a second liquid toward an adjacent region adjacent to the target treatment region such that a liquid film is formed in the target treatment region, and a control unit that controls a discharge amount of the second liquid discharged by the second nozzle unit such that the liquid film has a predetermined thickness.

A wet blasting treatment method according to one aspect of the disclosure includes first discharging of discharging, from a first nozzle unit toward a target treatment region, slurry in which a first liquid and abrasive grains are mixed, second discharging of discharging a second liquid from a second nozzle unit toward an adjacent region adjacent to the target treatment region such that a liquid film is formed in the target treatment region, and controlling a discharge amount of the second liquid discharged in the second discharging such that the liquid film has a predetermined thickness.

According to the disclosure, it is possible to provide a wet blasting treatment device and a wet blasting treatment method that are capable of adjusting a machining amount of an object to be treated per unit time without increasing an introduction cost and a running cost.

BRIEF DESCRIPTION OF DRAWINGS

The disclosure will be described with reference to the accompanying drawings, wherein like numbers reference like elements.

DESCRIPTION OF EMBODIMENTS

First Embodiment

Figure 1:
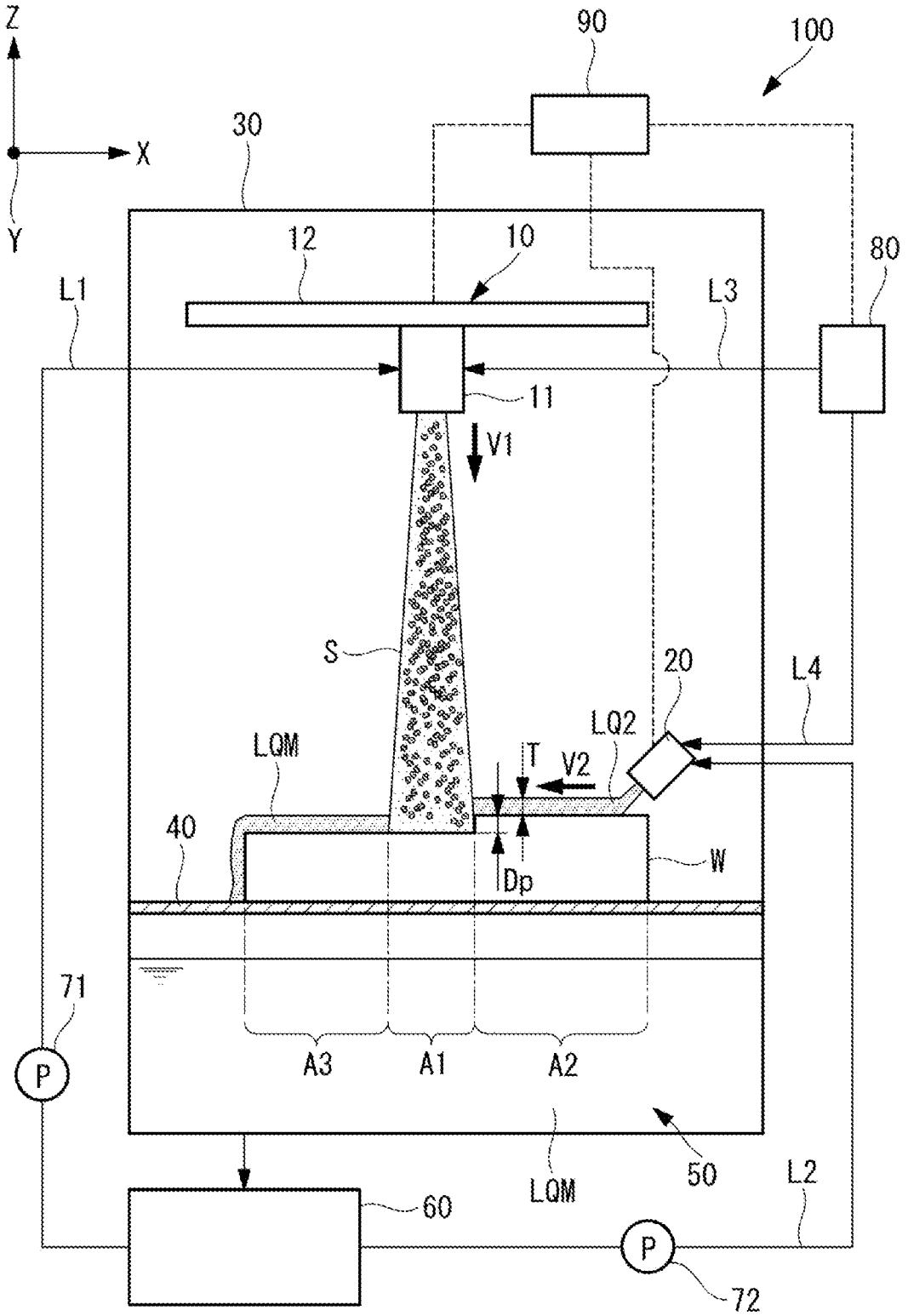
FIG. 1 is a schematic configuration diagram of a wet blasting treatment device according to a first embodiment of the disclosure.

A wet blasting treatment device 100 according to a first embodiment of the disclosure will be described below with reference to the drawings. FIG. 1 is a schematic configuration diagram of the wet blasting treatment device 100 according to the first embodiment of the disclosure.

As illustrated in FIG. 1, the wet blasting treatment device 100 of the present embodiment includes a first nozzle unit 10, a second nozzle unit 20, a case 30, an installation stand 40, a recovery unit 50, a separation unit 60, a first pump 71, a second pump 72, a compressed gas supply source 80, and a control unit 90. The wet blasting treatment device 100 is a device that machines the surface of a workpiece (object to be treated) W by spraying abrasive grains to the surface of the workpiece W installed on the installation stand 40. The workpiece W is formed of, for example, a metal material.

The first nozzle unit 10 is a device for discharging slurry S obtained by mixing a liquid (first liquid) and the abrasive grains toward a target treatment region A1 of the surface of the workpiece W. The first nozzle unit 10 includes a nozzle body 11 and a movement mechanism 12. The nozzle body 11 accelerates the slurry S supplied from the separation unit 60 via a slurry supply line L1 by high-pressure compressed gas (for example, compressed air) supplied from the compressed gas supply source 80, and discharges the slurry S in a direction along a Z axis extending in the vertical direction toward the target treatment region A1.

The movement mechanism 12 is a mechanism that moves the nozzle body 11 to a given position in an XY plane defined by an X axis extending in the horizontal direction and a Y axis orthogonal to the X axis. The first nozzle unit 10 moves the nozzle body 11 to a given position in the XY plane by the movement mechanism 12, and discharges the slurry S to a desired position of the workpiece W. FIG. 1 illustrates a state in which the movement mechanism 12 moves the nozzle body 11 from left to right along the X axis in a state in which the nozzle body 11 is fixed at a predetermined position on the Y axis. The Z axis is an axis orthogonal to the X axis and the Y axis. The nozzle body 11 discharges the slurry S in a direction along the Z axis.

The movement mechanism 12 is a mechanism that moves the nozzle body 11 to a given position in the XY plane, but may have another mode. For example, the movement mechanism 12 may be a mechanism that moves the nozzle body 11 along not only the X axis or the Y axis but also the Z axis. In this case, the movement mechanism 12 moves the nozzle body 11 to a given position in an XYZ space defined by the X axis, the Y axis, and the Z axis. The nozzle body 11 may include an angle adjustment mechanism (not illustrated) that changes the discharge direction of the slurry S by a given inclination angle with respect to the Z axis.

In FIG. 1, the target treatment region A1 of the workpiece W is a region where the slurry S is discharged from the first nozzle unit 10, and is a region machined by the wet blasting treatment device 100. An untreated region (adjacent region) A2 of the workpiece W is a region adjacent to the target treatment region A1, and is a region not machined by the slurry S. A treated region A3 of the workpiece W is a region adjacent to the target treatment region A1, and is a region that has already been machined by the slurry S.

The liquid contained in the slurry S is, for example, pure water. The abrasive grains contained in the slurry S are formed of, for example, stainless steel, ceramics, alumina, or tungsten carbide. The grain size of the abrasive grains is preferably 1 μm or greater and 1 mm or less.

The volume ratio of the abrasive grains contained in the slurry S is preferably 1% or greater and 99% or less. The volume ratio of the abrasive grains contained in the slurry S is more preferably 20% or greater and 99% or less. The volume ratio of the abrasive grains contained in the slurry S is still more preferably 50% or greater and 99% or less.

The second nozzle unit 20 is a device that discharges a liquid (second liquid) LQ2 toward the untreated region A2 adjacent to the target treatment region A1 such that a liquid film is formed in the target treatment region A1 of the workpiece W. The liquid LQ2 discharged to the untreated region A2 passes through the surfaces of the target treatment region A1 and the treated region A3, and is guided from the installation stand 40 to the recovery unit 50. The liquid LQ2 discharged from the second nozzle unit 20 is, for example, pure water.

The case 30 accommodates the first nozzle unit 10, the second nozzle unit 20, the installation stand 40, and the workpiece W inside thereof. The installation stand 40 is attached to a lower part of the case 30. The installation stand 40 is a plate-shaped member that supports the workpiece W. The installation stand 40 is formed with a plurality of through holes (not illustrated) for guiding, to the recovery unit 50, a mixed liquid LQM of the slurry S and the liquid LQ2 that has passed through the target treatment region A1 and the treated region A3 of the workpiece W and dropped from the workpiece W.

The recovery unit 50 is a device that stores the mixed liquid LQM of the slurry S and the liquid LQ2. The mixed liquid LQM that has passed through the target treatment region A1 and the treated region A3 of the workpiece W and dropped from the workpiece W is recovered by the recovery unit 50. The mixed liquid LQM recovered by the recovery unit 50 is guided to the separation unit 60.

The separation unit 60 is a device that separates the mixed liquid LQM recovered by the recovery unit 50 into a liquid (third liquid) containing the abrasive grains and a liquid (fourth liquid) not containing the abrasive grains. The liquid containing the abrasive grains separated by the separation unit 60 is supplied to the first nozzle unit 10 via the slurry supply line L1 by the power of the first pump 71. The liquid not containing the abrasive grains separated by the separation unit 60 is supplied to the second nozzle unit 20 via a pure water supply line L2 by the power of the second pump 72.

The compressed gas supply source 80 is a device that supplies the first nozzle unit 10 and the second nozzle unit 20 with high-pressure compressed gas (for example, compressed air) for discharging the liquids. The compressed gas supply source 80 supplies the compressed gas to the first nozzle unit 10 via a compressed gas supply line L3. The compressed gas supply source 80 supplies the compressed gas to the second nozzle unit 20 via a compressed gas supply line L4.

The control unit 90 is a device that controls the first nozzle unit 10, the second nozzle unit 20, the first pump 71, the second pump 72, and the compressed gas supply source 80. The control unit 90 controls the discharge amount of the liquid LQ2 discharged from the second nozzle unit 20 such that the liquid film formed on the surface of the workpiece W by the liquid LQ2 discharged from the second nozzle unit 20 has a predetermined thickness T.

The predetermined thickness T of the liquid film is set in advance according to a machining depth Dp, which is a target value for cutting the surface by machining the workpiece W, a target value of the surface roughness of the workpiece W after the machining, and the like. When the machining depth Dp is increased, the predetermined thickness T is reduced so that the collision speed when the abrasive grains collide with the surface of the workpiece W is increased. In the case of reducing the surface roughness to perform high-quality surface machining, the predetermined thickness T is increased so that the collision speed when the abrasive grains collide with the surface of the workpiece W is reduced.

The control unit 90 preferably controls the discharge speed of the liquid LQ2 such that the second speed V2 of the liquid LQ2 when the second nozzle unit 20 discharges the liquid LQ2 becomes higher than the first speed V1 of the slurry S when the first nozzle unit 10 discharges the slurry S. By making the second speed V2 higher than the first speed V1, it is possible to adjust, to a desired angle, the collision angle when the abrasive grains collide with the surface of the workpiece W.

Figure 2:
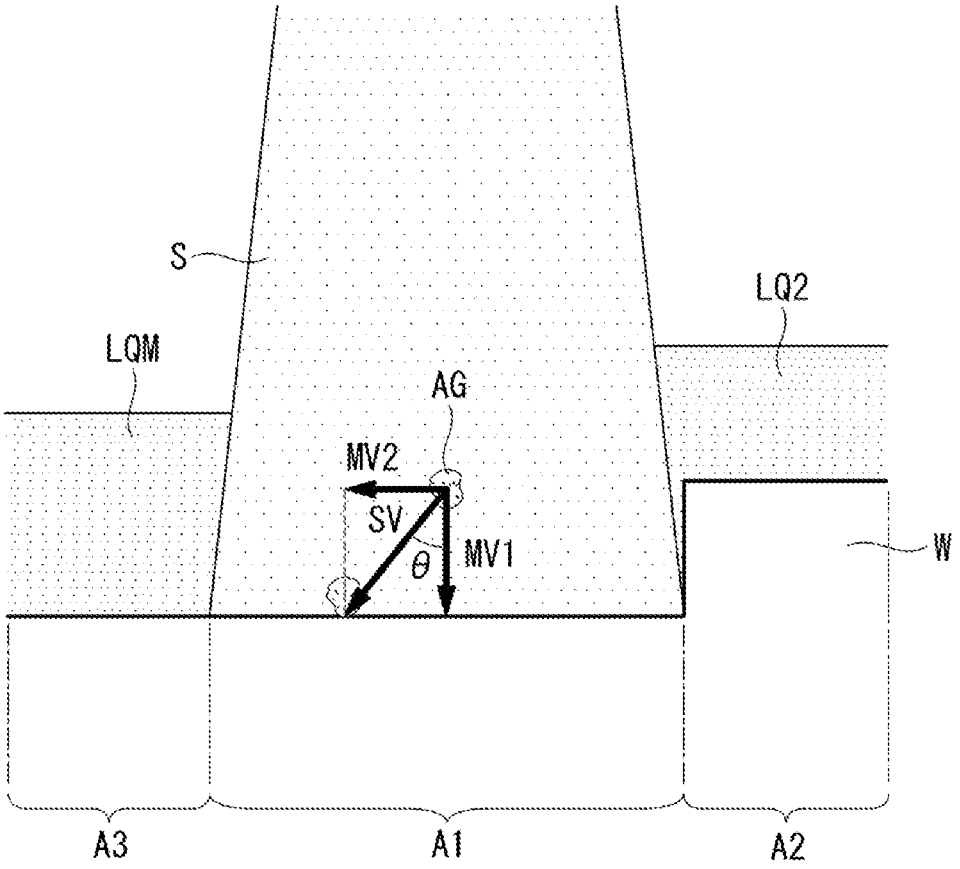
FIG. 2 is a partially enlarged view of a vicinity of a target treatment region illustrated in FIG. 1, and illustrates a collision direction of abrasive grains contained in slurry.

FIG. 2 is a partially enlarged view in the vicinity of the target treatment region A1 illustrated in FIG. 1, and illustrates a collision direction of abrasive grains AG contained in the slurry S. A speed component MV1 along the discharge direction of the slurry S and a speed component MV2 along the movement direction of the liquid LQ2 act on the abrasive grains AG illustrated in FIG. 2. A speed vector SV in which the speed component MV1 and the speed component MV2 are added acts on the abrasive grains AG.

Both the slurry S and the liquid LQ2 act on the abrasive grains AG, so that the abrasive grains AG move along the collision direction along the speed vector SV and collide with the surface of the workpiece W. As illustrated in FIG. 2, the collision direction of the abrasive grains AG is inclined at a predetermined angle θ with respect to the discharge direction of the slurry S. The control unit 90 adjusts the magnitude of the predetermined angle θ by controlling the second speed V2 of the liquid LQ2 discharged from the second nozzle unit 20. The control unit 90 decreases the predetermined angle θ by decreasing the second speed V2 and increases the predetermined angle θ by increasing the second speed V2.

Through examination, the present inventors have found that the machining depth of the workpiece W becomes deeper and the surface roughness of the workpiece W becomes smaller when the predetermined angle θ is larger than 0 degrees than when the predetermined angle θ is 0 degrees. It has been found that with an increase in the predetermined angle θ from 0 degrees to 30 degrees, the machining depth of the workpiece W gradually increases, and the surface roughness of the workpiece W gradually decreases. Thus, in the present embodiment, the control unit 90 controls the second speed V2 of the liquid LQ2 discharged from the second nozzle unit 20 such that the predetermined angle θ becomes a given angle of 10 degrees or greater and 30 degrees or less.

Figure 3:
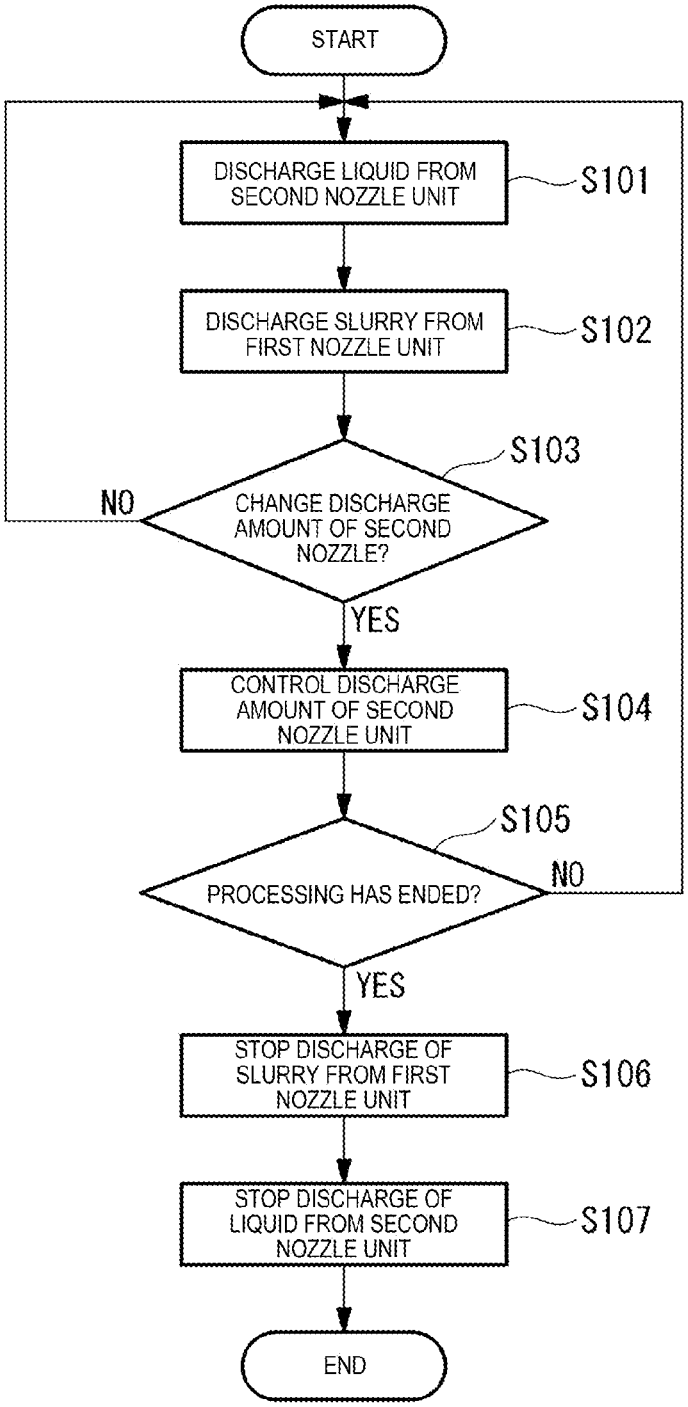
FIG. 3 is a flowchart illustrating a wet blasting treatment method according to the present embodiment.

Here, the wet blasting treatment method executed by the wet blasting treatment device 100 of the present embodiment will be described. FIG. 3 is a flowchart illustrating the wet blasting treatment method according to the present embodiment.

In step S101, the control unit 90 controls the second nozzle unit 20 to discharge a liquid toward the untreated region (adjacent region) A2 adjacent to the target treatment region A1 such that a liquid film is formed in the target treatment region A1 of the workpiece W. The control unit 90 preferably controls the discharge speed of the liquid LQ2 such that the second speed V2 of the liquid LQ2 when the second nozzle unit 20 discharges the liquid LQ2 becomes higher than the first speed V1 of the slurry S when the first nozzle unit 10 discharges the slurry S.

The control unit 90 controls the discharge speed of the liquid LQ2 such that the collision direction when the abrasive grains collide with the target treatment region A1 is inclined at the predetermined angle θ with respect to the discharge direction of the slurry S discharged from the first nozzle unit 10.

In step S102, the control unit 90 controls the first nozzle unit 10 and the compressed gas supply source 80 to discharge the slurry S toward the target treatment region A1 of the workpiece W. After starting discharging of the slurry S in step S102, the control unit 90 controls the movement mechanism 12 so that the nozzle body 11 discharges the slurry S to the untreated region A2.

In step S103, the control unit 90 determines whether to change the discharge amount of the liquid discharged from the second nozzle unit 20, and the processing proceeds to step S104 in the case of YES and steps S101 and S102 are repeated in the case of NO.

In step S104, the control unit 90 controls the discharge amount of the liquid discharged from the second nozzle unit 20 according to an instruction from the worker. In the case of increasing the machining depth Dp, the worker instructs a change in the discharge amount so as to reduce the predetermined thickness T in order to increase the collision speed when the abrasive grains collide with the surface of the workpiece W. In the case of reducing the surface roughness to perform high-quality surface machining, the worker instructs a change in the discharge amount so as to increase the predetermined thickness T in order to decrease the collision speed when the abrasive grains collide with the surface of the workpiece W.

In step S105, the control unit 90 determines whether to end the wet blasting treatment, and the processing proceeds to step S106 in the case of YES and step S101 is executed again in the case of NO.

In step S106, the control unit 90 controls the first nozzle unit 10 and the compressed gas supply source 80 so as to stop the operation of discharging the slurry S toward the target treatment region A1 of the workpiece W. The control unit 90 controls movement mechanism 12 so as to stop the movement of the nozzle body 11.

In step S107, the control unit 90 controls the second nozzle unit 20 to stop the operation of discharging the liquid toward the untreated region A2.

In the above description, the liquid discharged from the second nozzle unit 20 is pure water, but other modes may be adopted. For example, the liquid LQ2 discharged from the second nozzle unit 20 may be a water-insoluble and volatile solvent (for example, ketone-based solvents such as acetone and methyl propyl ketone, and fluorine-based solvents such as cis-1-chloro-3, 3, 3-trifluoropropene).

In this case, the separation unit 60 includes a function of separating the mixed liquid of the slurry S and the liquid LQ2 recovered by the recovery unit 50 into the slurry S (mixture of the pure water and the abrasive grains) and the liquid LQ2. The slurry S separated from the mixed liquid by the separation unit 60 is supplied to the first nozzle unit 10. On the other hand, the liquid LQ2 separated from the mixed liquid by the separation unit 60 is supplied to the second nozzle unit 20.

According to the wet blasting treatment device 100 of the above aspect, since the liquid LQ2 has volatility, it is possible to cool the target treatment region A1 by heat of evaporation when the liquid LQ2 volatilizes in the target treatment region A1, and to prevent a problem caused by excessive heating of the target treatment region A1 due to collision of the abrasive grains. Since the liquid contained in the slurry S discharged from the first nozzle unit 10 is pure water and the liquid LQ2 discharged from the second nozzle unit 20 is water-insoluble, the respective liquids can be separated by the separation unit 60 and supplied to the first nozzle unit 10 and the second nozzle unit 20.

Functions and effects of the wet blasting treatment device 100 of the present embodiment described above will be described.

According to the wet blasting treatment device 100 of the present embodiment, the slurry S is discharged from the first nozzle unit 10 toward the target treatment region A1 of the workpiece W, and the liquid LQ2 is discharged from the second nozzle unit 20 to the untreated region A2 adjacent to the target treatment region A1 such that a liquid film is formed in the target treatment region A1 of the workpiece W. The abrasive grains contained in the slurry S discharged from the first nozzle unit 10 collide with the liquid film, decelerate, and then collide with the target treatment region A1.

According to the wet blasting treatment device 100 of the present embodiment, the discharge amount of the liquid LQ2 discharged from the second nozzle unit 20 is controlled such that the liquid film has the predetermined thickness T. Even when the first speed V1 of the slurry S discharged from the first nozzle unit 10 is constant, the predetermined thickness T of the liquid film can be optionally controlled by the control unit 90 and thus the collision speed of the abrasive grains with the target treatment region A1 can be adjusted. Thus, it is possible to adjust the machining amount (machining depth) of the workpiece W per unit time without increasing the introduction cost and the running cost caused by adjusting the first speed V1 of the slurry S discharged from the first nozzle unit 10.

According to the wet blasting treatment device 100 of the present embodiment, by making the second speed V2 of the liquid LQ2 when the second nozzle unit 20 discharges the liquid LQ2 higher than the first speed V1 of the slurry S when the first nozzle unit 10 discharges the slurry S, it is possible to incline the collision direction when the abrasive grains AG collide with the target treatment region A1 from the discharge direction of the slurry S discharged from the first nozzle unit 10. This makes it possible to reduce the surface roughness of the target treatment region A1 and perform high-quality surface machining.

According to the wet blasting treatment device 100 of the present embodiment, it is possible to incline the collision direction of the abrasive grains AG by the predetermined angle θ of 10 degrees or greater and 30 degrees or less with respect to the discharge direction of the slurry S, and to reduce the surface roughness of the target treatment region A1 and perform high-quality surface machining.

According to the wet blasting treatment device 100 of the present embodiment, the volume ratio of the abrasive grains contained in the slurry S is 1% or greater, and thus the ratio of the liquid contained in the slurry S is reduced as compared with the case where the volume ratio of the abrasive grains contained in the slurry S is less than 1%. Thus, the imbalance between the regions where the abrasive grains collide and the regions where only the liquid collides in the target treatment region A1 is suppressed, and the difference in the machining amount in each part of the target treatment region A1 can be reduced. The volume ratio of the abrasive grains contained in the slurry S is 15% or less, and thus it is possible to suppress abrasion of the slurry supply line (pipe) L1 through which the slurry flows as compared with the case where the volume ratio of the abrasive grains contained in the slurry is more than 15%.

Second Embodiment

Next, a wet blasting treatment device 100A according to a second embodiment of the disclosure will be described with reference to the drawings. The present embodiment is a modification example of the first embodiment, and is the same as the first embodiment unless otherwise described below.

Figure 4:
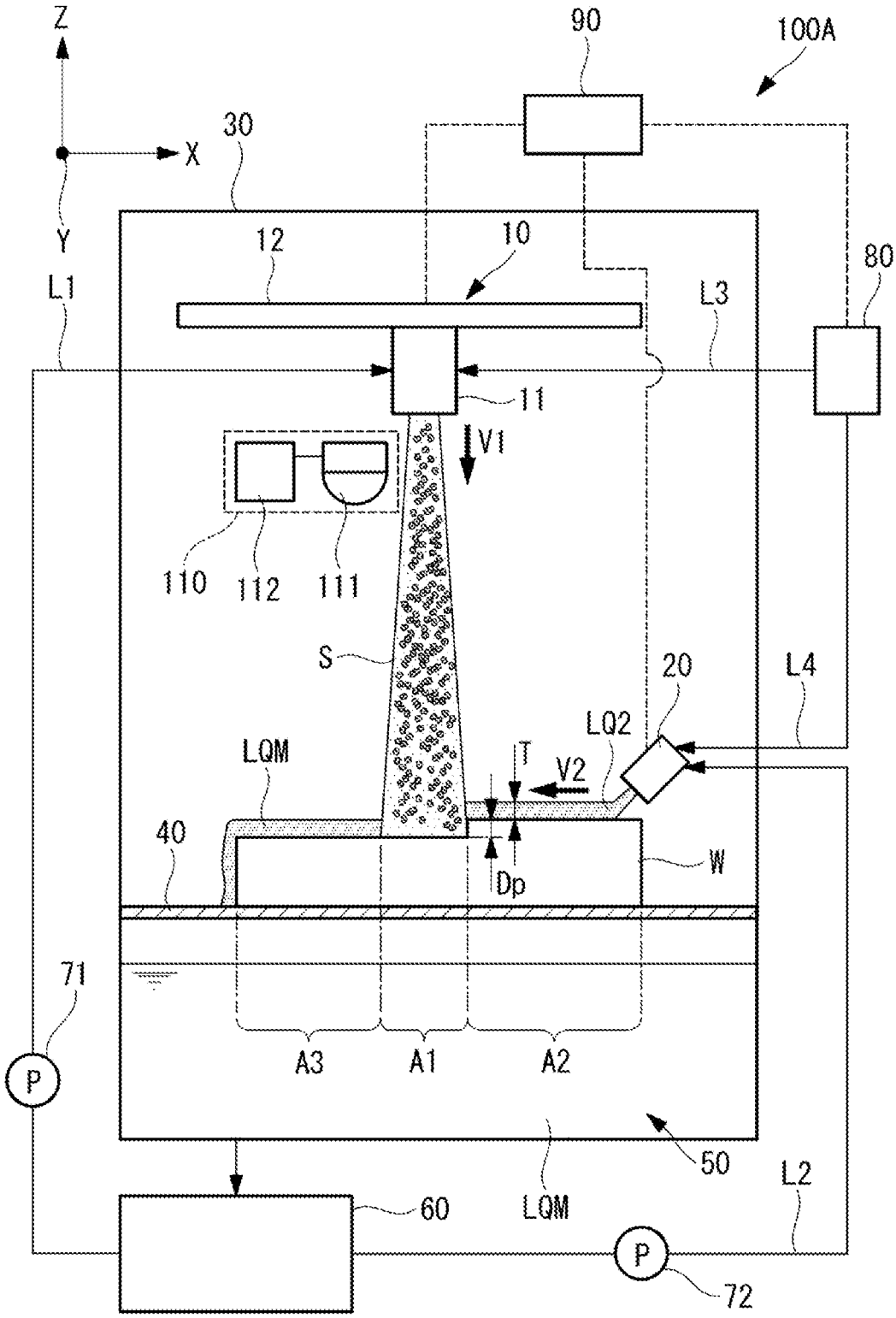
FIG. 4 is a schematic configuration diagram of a wet blasting treatment device according to a second embodiment of the disclosure.

The wet blasting treatment device 100A of the present embodiment is different from the wet blasting treatment device 100 of the first embodiment in including a calculation unit 110. FIG. 4 is a schematic configuration diagram of the wet blasting treatment device 100A according to the second embodiment of the disclosure. As illustrated in FIG. 4, the wet blasting treatment device 100A of the present embodiment includes the calculation unit 110.

The calculation unit 110 includes an imaging unit 111 that acquires an image of the surface of the workpiece W including the target treatment region A1, and an image processing unit 112 that processes the image captured by the imaging unit 111 and calculates the machining depth Dp of the workpiece W machined by surface treatment performed for the workpiece W. The image processing unit 112 calculates the machining depth Dp, for example, by comparing an image obtained by capturing the target treatment region A1 of the surface of the workpiece W installed on the installation stand 40 before the surface treatment is performed with an image obtained by capturing the target treatment region A1 of the surface of the workpiece W installed on the installation stand 40 while the surface treatment is performed.

For example, by executing a calculation step of the machining depth Dp by the calculation unit 110 before step S103 of FIG. 3, the machining depth Dp calculated by the calculation unit 110 can be used in the determination in step S103 of FIG. 3 and the control of the discharge amount of the second nozzle unit 20 in step S104. For example, when the machining depth Dp calculated by the calculation unit 110 is deeper than a predetermined target machining depth, the worker instructs a change in the discharge amount to increase the predetermined thickness T in order to reduce the collision speed when the abrasive grains collide with the surface of the workpiece W.

When the machining depth Dp calculated by the calculation unit 110 is shallower than the predetermined target machining depth, the worker instructs a change in the discharge amount to reduce the predetermined thickness T in order to increase the collision speed when the abrasive grains collide with the surface of the workpiece W. These make it possible to adjust the machining depth machined by the wet blasting treatment device 100 at one time to an appropriate amount when the wet blasting treatment is repeated a plurality of times and a final machining depth is achieved.

In this manner, since the calculation unit 110 can calculate the machining depth Dp of the target treatment region A1, the wet blasting treatment device 100A of the present embodiment can perform appropriate surface machining such as adjusting the thickness of the liquid film according to the machining depth Dp.

Third Embodiment

Next, a wet blasting treatment device 100B according to a third embodiment of the disclosure will be described with reference to the drawings. The present embodiment is a modification example of the first embodiment, and is the same as the first embodiment unless otherwise described below.

Figure 5:
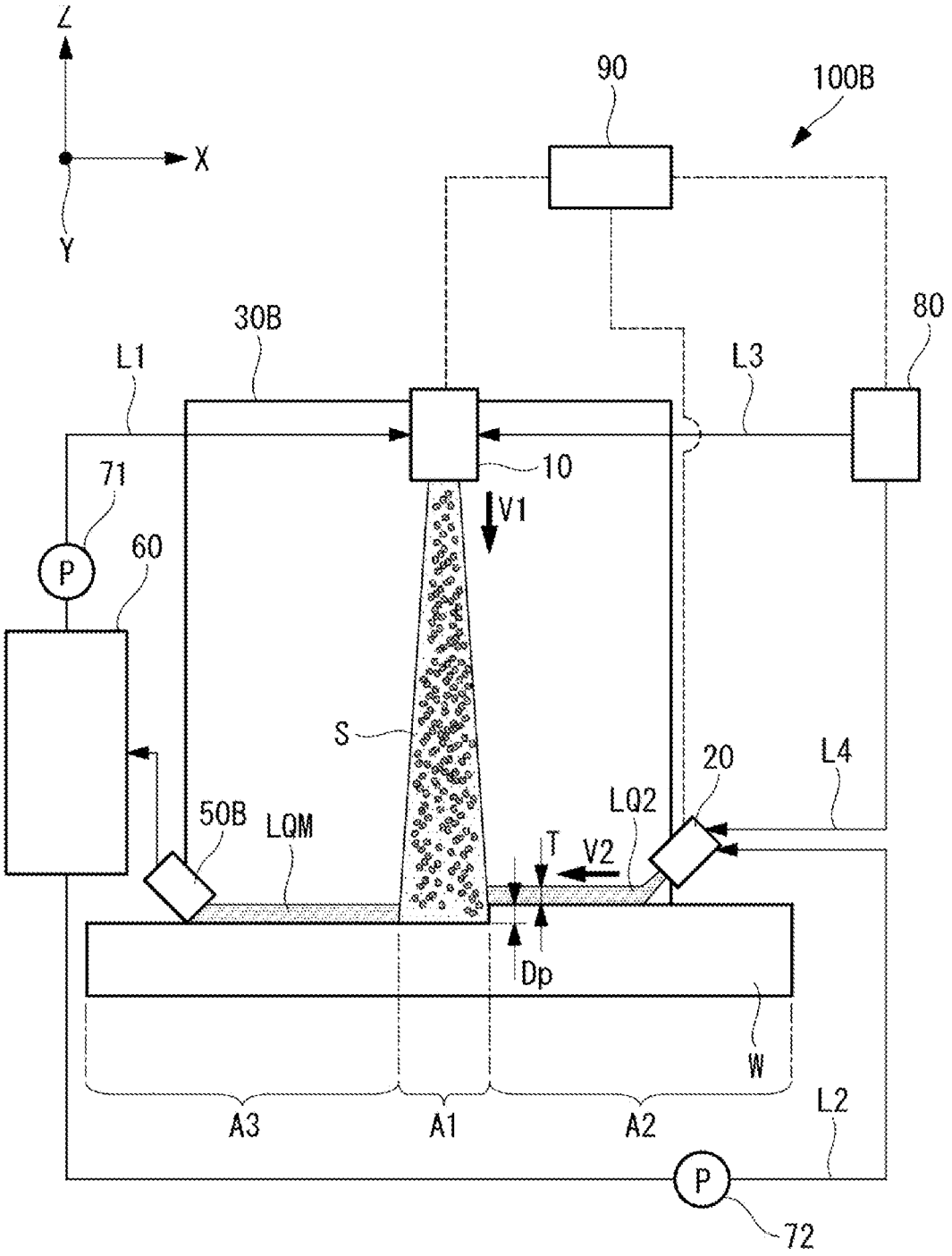
FIG. 5 is a schematic configuration diagram of a wet blasting treatment device according to a third embodiment of the disclosure.

In the wet blasting treatment device 100B of the present embodiment, the first nozzle unit 10, the second nozzle unit 20, and a recovery unit 50B are integrally formed so as to be movable with respect to the workpiece W. FIG. 5 is a schematic configuration diagram of the wet blasting treatment device 100B according to the third embodiment of the disclosure.

As illustrated in FIG. 5, in the wet blasting treatment device 100B, the first nozzle unit 10, the second nozzle unit 20, and the recovery unit 50B are attached to and integrated with a case 30B. The recovery unit 50B of the present embodiment sucks and guides, to the separation unit 60, the mixed liquid LQM of the slurry S discharged from the first nozzle unit 10 and the liquid LQ2 discharged from the second nozzle unit 20.

According to the wet blasting treatment device 100B of the present embodiment, the mixed liquid LQM of the slurry S and the liquid LQ2 mixed in the target treatment region A1 is recovered by the recovery unit 50B. The mixed liquid LQM is separated, in the separation unit 60, into a liquid (third liquid) containing the abrasive grains and a liquid (fourth liquid) not containing the abrasive grains, and the respective liquids are supplied to the first nozzle unit and the second nozzle unit 20. Since the first nozzle unit 10, the second nozzle unit 20, and the recovery unit 50B are integrally formed so as to be movable, the first nozzle unit 10, the second nozzle unit 20, and the recovery unit 50B can be moved to given positions of the workpiece W, and the surface machining of the target treatment region A1 can be easily performed.

The wet blasting treatment device described in the embodiments described above is understood as follows, for example.

A wet blasting treatment device (100) according to one aspect of the disclosure includes a first nozzle unit (10) that discharges, toward a target treatment region (A1), slurry in which a first liquid and abrasive grains are mixed, a second nozzle unit (20) that discharges a second liquid toward an adjacent region adjacent to the target treatment region such that a liquid film is formed in the target treatment region, and a control unit (90) that controls a discharge amount of the second liquid discharged by the second nozzle unit such that the liquid film has a predetermined thickness.

According to the wet blasting treatment device according to one aspect of the disclosure, the slurry is discharged from the first nozzle unit toward the target treatment region, and the second liquid is discharged from the second nozzle unit to the adjacent region adjacent to the target treatment region such that the liquid film is formed in the target treatment region. The abrasive grains contained in the slurry discharged from the first nozzle unit collide with the liquid film, decelerate, and then collide with the target treatment region.

According to the wet blasting treatment device according to one aspect of the disclosure, the discharge amount of the second liquid discharged from the second nozzle unit is controlled such that the liquid film has a predetermined thickness. Even when the discharge speed of the slurry discharged from the first nozzle unit is constant, the predetermined thickness of the liquid film can be optionally controlled by the control unit, and thus the collision speed of the abrasive grains with the target treatment region can be adjusted. Thus, it is possible to adjust the machining amount of the target treatment region per unit time without increasing the introduction cost and the running cost caused by adjusting the discharge speed of the slurry discharged from the first nozzle unit.

In the wet blasting treatment device according to one aspect of the disclosure, the control unit may be configured to control a discharge speed of the second liquid such that a second speed of the second liquid when the second nozzle unit discharges the second liquid is higher than a first speed of the slurry when the first nozzle unit discharges the slurry.

According to the wet blasting treatment device of the present configuration, by making the second speed of the second liquid when the second nozzle unit discharges the second liquid higher than the first speed of the slurry when the first nozzle unit discharges the slurry, it is possible to incline the collision direction when the abrasive grains collide with the target treatment region from the discharge direction of the slurry discharged from the first nozzle unit. This makes it possible to reduce the surface roughness of the target treatment region and to perform high-quality surface machining.

In the wet blasting treatment device according to one aspect of the disclosure, the control unit may be configured to control the discharge speed of the second liquid such that a collision direction when the abrasive grains collide with the target treatment region is inclined by a predetermined angle (0) with respect to the discharge direction of the slurry discharged from the first nozzle unit, and the predetermined angle is 10 degrees or greater and 30 degrees or less.

According to the wet blasting treatment device of the present configuration, by inclining the collision direction of the abrasive grains by the predetermined angle of 10 degrees or greater and 30 degrees or less with respect to the discharge direction of the slurry, it is possible to reduce the surface roughness of the target treatment region and to perform high-quality surface machining.

The wet blasting treatment device according to one aspect of the disclosure may be configured to include a calculation unit (110) that acquires an image including the target treatment region and calculates a machining depth (Dp) of the target treatment region machined by the abrasive grains.

According to the wet blasting treatment device of the present configuration, since it is possible to calculate the machining depth of the target treatment region by the calculation unit, it is possible to perform appropriate surface machining such as adjusting the thickness of the liquid film according to the machining depth.

The wet blasting treatment device according to one aspect of the disclosure may be configured such that the first liquid is water, the second liquid is a water-insoluble and volatile liquid, the wet blasting treatment device includes a recovery unit (50) that recovers a mixed liquid in which the first liquid and the second liquid are mixed, and a separation unit (60) that separates the second liquid from the mixed liquid recovered by the recovery unit, the first liquid separated by the separation unit is supplied to the first nozzle unit, and the second liquid separated by the separation unit is supplied to the second nozzle unit.

According to the wet blasting treatment device of the present configuration, since the second liquid has volatility, it is possible to cool the target treatment region by heat of evaporation when the second liquid volatilizes in the target treatment region, and it is possible to prevent a problem caused by excessive heating of the target treatment region due to collision of the abrasive grains. Since the first liquid is water and the second liquid is water-insoluble, the first liquid and the second liquid can be separated by the separation unit, and are supplied to the first nozzle unit and the second nozzle unit, respectively.

The wet blasting treatment device according to one aspect of the disclosure may include a recovery unit (50B) that recovers a mixed liquid in which the first liquid and the second liquid are mixed, and a separation unit (60) that separates the mixed liquid recovered by the recovery unit into a third liquid containing the abrasive grains and a fourth liquid not containing the abrasive grains, in which the third liquid separated by the separation unit is supplied to the first nozzle unit, and the fourth liquid separated by the separation unit is supplied to the second nozzle unit, and the first nozzle unit, the second nozzle unit, and the recovery unit are integrally formed to be movable.

According to the wet blasting treatment device of the present configuration, the mixed liquid of the first liquid and the second liquid mixed in the target treatment region is recovered by the recovery unit. The mixed liquid is separated, in the separation unit, into the third liquid containing the abrasive grains and the fourth liquid not containing the abrasive grains, and the respective liquids are supplied to the first nozzle unit and the second nozzle unit. Since the first nozzle unit, the second nozzle unit, and the recovery unit are integrally formed so as to be movable, the first nozzle unit, the second nozzle unit, and the recovery unit can be moved to given positions of the object to be treated, and the surface machining of the target treatment region can be easily performed.

The wet blasting treatment device according to one aspect of the disclosure may be configured such that the volume ratio of the abrasive grains contained in the slurry is 1% or greater (more preferably 20% or greater).

According to the wet blasting treatment device of the present configuration, by making the volume ratio of the abrasive grains contained in the slurry 1% or greater, the ratio of the liquid contained in the slurry is reduced as compared with the case where the volume ratio of the abrasive grains contained in the slurry is less than 1%. By making the volume ratio of the abrasive grains contained in the slurry 20% or greater, the ratio of the liquid contained in the slurry is reduced as compared with the case where the volume ratio of the abrasive grains contained in the slurry is less than 20%. Thus, the imbalance between the regions where the abrasive grains collide and the regions where only the liquid collides in the target treatment region is suppressed, and the difference in the machining amount in each part of the target treatment region can be reduced.

The wet blasting treatment method described in the embodiments described above is understood as follows, for example.

The wet blasting treatment method according to one aspect of the disclosure includes a first discharging step (S101) of discharging, from a first nozzle unit toward a target treatment region, slurry in which a first liquid and abrasive grains are mixed, a second discharging step (S102) of discharging a second liquid from a second nozzle unit toward an adjacent region adjacent to the target treatment region such that a liquid film is formed in the target treatment region, and a control step (S104) of controlling a discharge amount of the second liquid discharged in the second discharging step such that the liquid film has a predetermined thickness.

According to the wet blasting treatment method according to one aspect of the disclosure, the slurry is discharged from the first nozzle unit toward the target treatment region, and the second liquid is discharged from the second nozzle unit to the adjacent region adjacent to the target treatment region such that the liquid film is formed in the target treatment region. The abrasive grains contained in the slurry discharged from the first nozzle unit collide with the liquid film, decelerate, and then collide with the target treatment region.

According to the wet blasting treatment device according to one aspect of the disclosure, the discharge amount of the second liquid discharged from the second nozzle unit is controlled such that the liquid film has a predetermined thickness. Even when the discharge speed of the slurry discharged from the first nozzle unit is constant, the predetermined thickness of the liquid film can be optionally controlled in the control step, and thus the collision speed of the abrasive grains with the target treatment region can be adjusted. Thus, it is possible to adjust the machining amount of the target treatment region per unit time without increasing the introduction cost and the running cost caused by adjusting the discharge speed of the slurry discharged from the first nozzle unit.

The wet blasting treatment method according to one aspect of the disclosure may be configured such that, in the control step, a discharge speed of the second liquid is controlled such that a second speed of the second liquid when the second nozzle unit discharges the second liquid is higher than a first speed of the slurry when the first nozzle unit discharges the slurry.

According to the wet blasting treatment method of the present configuration, by making the second speed of the second liquid when the second nozzle unit discharges the second liquid higher than the first speed of the slurry when the first nozzle unit discharges the slurry, it is possible to incline the collision direction when the abrasive grains collide with the target treatment region from the discharge direction of the slurry discharged from the first nozzle unit. This makes it possible to reduce the surface roughness of the target treatment region and to perform high-quality surface machining.

The wet blasting treatment method according to one aspect of the disclosure may be configured such that, in the control step, the discharge speed of the second liquid is controlled such that a collision direction when the abrasive grains collide with the target treatment region is inclined by a predetermined angle with respect to a discharge direction of the slurry discharged from the first nozzle unit, and the predetermined angle is 10 degrees or greater and 30 degrees or less.

According to the wet blasting treatment method of the present configuration, by inclining the collision direction of the abrasive grains by the predetermined angle of 10 degrees or greater and 30 degrees or less with respect to the discharge direction of the slurry, it is possible to reduce the surface roughness of the target treatment region and to perform high-quality surface machining.

The wet blasting treatment method according to one aspect of the disclosure may be configured to include a calculation step of acquiring an image including the target treatment region and calculating a machining depth of the target treatment region machined by the abrasive grains.

According to the wet blasting treatment method of the present configuration, since it is possible to calculate the machining depth of the target treatment region by the calculation unit, it is possible to perform appropriate surface machining such as adjusting the thickness of the liquid film according to the machining depth.

The wet blasting treatment method according to one aspect of the disclosure may be configured such that the first liquid is water, the second liquid is a water-insoluble and volatile liquid, the wet blasting treatment method includes a recovery step of recovering a mixed liquid in which the first liquid and the second liquid are mixed, and a separation step of separating the second liquid from the mixed liquid recovered in the recovery step, the first liquid separated in the separation step is supplied to the first nozzle unit, and the second liquid separated in the separation step is supplied to the second nozzle unit.

According to the wet blasting treatment method of the present configuration, since the second liquid has volatility, it is possible to cool the target treatment region by heat of evaporation when the second liquid volatilizes in the target treatment region, and it is possible to prevent a problem caused by excessive heating of the target treatment region. Since the first liquid is water and the second liquid is water-insoluble, the first liquid and the second liquid can be separated in the separation step, and are supplied to the first nozzle unit and the second nozzle unit, respectively.

The wet blasting treatment method according to one aspect of the disclosure may include a recovery step of recovering, to a recovery unit, a mixed liquid in which the first liquid and the second liquid are mixed, and a separation step of separating the mixed liquid recovered in the recovery step into a third liquid containing the abrasive grains and a fourth liquid not containing the abrasive grains, in which the third liquid separated in the separation step is supplied to the first nozzle unit, and the fourth liquid separated in the separation step is supplied to the second nozzle unit, and the first nozzle unit, the second nozzle unit, and the recovery unit are integrally formed be movable.

According to the wet blasting treatment method of the present configuration, the mixed liquid of the first liquid and the second liquid mixed in the target treatment region is recovered by the recovery unit. The mixed liquid is separated, in the separation step, into the third liquid containing the abrasive grains and the fourth liquid not containing the abrasive grains, and the respective liquids are supplied to the first nozzle unit and the second nozzle unit. Since the first nozzle unit, the second nozzle unit, and the recovery unit are integrally formed so as to be movable, the first nozzle unit, the second nozzle unit, and the recovery unit can be moved to given positions of the object to be treated, and the surface machining of the target treatment region can be easily performed.

The wet blasting treatment method according to one aspect of the disclosure may be configured such that the volume ratio of the abrasive grains contained in the slurry is 1% or greater and 50% or less.

According to the wet blasting treatment method of the present configuration, by making the volume ratio of the abrasive grains contained in the slurry 1% or greater, the ratio of the liquid contained in the slurry is reduced as compared with the case where the volume ratio of the abrasive grains contained in the slurry is less than 1%. Thus, the imbalance between the regions where the abrasive grains collide and the regions where only the liquid collides in the target treatment region is suppressed, and the difference in the machining amount in each part of the target treatment region can be reduced. By making the volume ratio of the abrasive grains contained in the slurry 50% or less, it is possible to suppress abrasion of the pipe through which the slurry flows as compared with the case where the volume ratio of the abrasive grains contained in the slurry is 50% or greater.

While preferred embodiments of the invention have been described as above, it is to be understood that variations and modifications will be apparent to those skilled in the art without departing from the scope and spirit of the invention. The scope of the invention, therefore, is to be determined solely by the following claims.

The invention claimed is:

1. A wet blasting treatment device comprising:

a first nozzle unit configured to discharge, toward a target treatment region of a surface of a target, slurry in which a first liquid and abrasive grains are mixed to perform machining that cuts the target treatment region;

a second nozzle unit configured to discharge a second liquid toward an untreated region of the surface of the target adjacent to the target treatment region such that a liquid film of the second liquid is formed in the target treatment region, the untreated region being a region not machined by the slurry, the liquid film decelerating the abrasive grains in the slurry discharged from the first nozzle; and a control unit configured to control a discharge amount of the second liquid discharged by the second nozzle unit such that the liquid film has a predetermined thickness, the predetermined thickness being set according to a target value of a machining depth of the target treatment region.

2. The wet blasting treatment device according to claim 1, wherein the control unit controls a discharge speed of the second liquid such that a second speed of the second liquid when the second nozzle unit discharges the second liquid is higher than a first speed of the slurry when the first nozzle unit discharges the slurry.

3. The wet blasting treatment device according to claim 1, wherein the first liquid is water, the second liquid is a water-insoluble and volatile liquid, the wet blasting treatment device includes a recovery unit configured to recover a mixed liquid in which the first liquid and the second liquid are mixed, and a separation unit configured to separate the second liquid from the mixed liquid recovered by the recovery unit, the first liquid separated by the separation unit is supplied to the first nozzle unit, and the second liquid separated by the separation unit is supplied to the second nozzle unit.

4. The wet blasting treatment device according to claim 1, further comprising:

a recovery unit configured to recover a mixed liquid in which the first liquid and the second liquid are mixed; and a separation unit configured to separate the mixed liquid recovered by the recovery unit into a third liquid containing the abrasive grains and a fourth liquid not containing the abrasive grains, wherein the third liquid separated by the separation unit is supplied to the first nozzle unit, and the fourth liquid separated by the separation unit is supplied to the second nozzle unit, and the first nozzle unit, the second nozzle unit, and the recovery unit are integrally formed to be movable.

5. The wet blasting treatment device according to claim 1, wherein a volume ratio of the abrasive grains contained in the slurry is 1% or greater.

6. The wet blasting treatment device according to claim 1, wherein a volume ratio of the abrasive grains contained in the slurry is 20% or greater.

7. A wet blasting treatment device comprising:

a first nozzle unit configured to discharge, toward a target treatment region, slurry in which a first liquid and abrasive grains are mixed;

a second nozzle unit configured to discharge a second liquid toward an adjacent region adjacent to the target treatment region such that a liquid film is formed in the target treatment region; and a control unit configured to control a discharge amount of the second liquid discharged by the second nozzle unit such that the liquid film has a predetermined thickness, wherein the control unit controls the discharge speed of the second liquid such that a collision direction when the abrasive grains collide with the target treatment region is inclined by a predetermined angle with respect to a discharge direction of the slurry discharged from the first nozzle unit, and the predetermined angle is 10 degrees or greater and 30 degrees or less.

8. A wet blasting treatment device comprising:

a first nozzle unit configured to discharge, toward a target treatment region, slurry in which a first liquid and abrasive grains are mixed;

a second nozzle unit configured to discharge a second liquid toward an adjacent region adjacent to the target treatment region such that a liquid film is formed in the target treatment region; and a control unit configured to control a discharge amount of the second liquid discharged by the second nozzle unit such that the liquid film has a predetermined thickness, further comprising a calculation unit configured to acquire an image including the target treatment region and calculate a machining depth of the target treatment region machined by the abrasive grains.

9. A wet blasting treatment method comprising:

first discharging of discharging, from a first nozzle unit toward a target treatment region of a surface of a target, slurry in which a first liquid and abrasive grains are mixed to perform machining that cuts the target treatment region;

second discharging of discharging a second liquid from a second nozzle unit toward an untreated region of the surface of the target adjacent to the target treatment region such that a liquid film of the second liquid is formed in the target treatment region, the untreated region being a region not machined by the slurry, the liquid film decelerating the abrasive grains in the slurry discharged from the first nozzle; and controlling a discharge amount of the second liquid discharged in the second discharging such that the liquid film has a predetermined thickness, the predetermined thickness being set according to a target value of a machining depth of the target treatment region.

10. The wet blasting treatment method according to claim 9, wherein the first liquid is water, the second liquid is a water-insoluble and volatile liquid, the wet blasting treatment method includes recovering a mixed liquid in which the first liquid and the second liquid are mixed, and separating the second liquid from the mixed liquid recovered in the recovering, the first liquid separated in the separating is supplied to the first nozzle unit, and the second liquid separated in the separating is supplied to the second nozzle unit.

11. The wet blasting treatment method according to claim 9, further comprising:

recovering, to a recovery unit, a mixed liquid in which the first liquid and the second liquid are mixed; and separating the mixed liquid recovered in the recovering into a third liquid containing the abrasive grains and a fourth liquid not containing the abrasive grains, wherein the third liquid separated in the separating is supplied to the first nozzle unit, and the fourth liquid separated in the separating is supplied to the second nozzle unit, and the first nozzle unit, the second nozzle unit, and the recovery unit are integrally formed to be movable.

12. The wet blasting treatment method according to claim 9, wherein a volume ratio of the abrasive grains contained in the slurry is 1% or greater and 15% or less.

13. A wet blasting treatment method comprising:

first discharging of discharging, from a first nozzle unit toward a target treatment region, slurry in which a first liquid and abrasive grains are mixed;

second discharging of discharging a second liquid from a second nozzle unit toward an adjacent region adjacent to the target treatment region such that a liquid film is formed in the target treatment region; and controlling a discharge amount of the second liquid discharged in the second discharging such that the liquid film has a predetermined thickness, wherein in the controlling, a discharge speed of the second liquid is controlled such that a second speed of the second liquid when the second nozzle unit discharges the second liquid is higher than a first speed of the slurry when the first nozzle unit discharges the slurry, wherein in the controlling, the discharge speed of the second liquid is controlled such that a collision direction when the abrasive grains collide with the target treatment region is inclined by a predetermined angle with respect to a discharge direction of the slurry discharged from the first nozzle unit, and the predetermined angle is 10 degrees or greater and 30 degrees or less.

14. A wet blasting treatment method comprising:

first discharging of discharging, from a first nozzle unit toward a target treatment region, slurry in which a first liquid and abrasive grains are mixed;

second discharging of discharging a second liquid from a second nozzle unit toward an adjacent region adjacent to the target treatment region such that a liquid film is formed in the target treatment region; and controlling a discharge amount of the second liquid discharged in the second discharging such that the liquid film has a predetermined thickness, further comprising acquiring an image including the target treatment region and calculating a machining depth of the target treatment region machined by the abrasive grains.

* * * * *